United States Patent [19]

Takenaka et al.

[11] Patent Number: 4,702,677

[45] Date of Patent: Oct. 27, 1987

[54] VARIABLE DISPLACEMENT WOBBLE PLATE TYPE COMPRESSOR WITH IMPROVED WOBBLE ANGLE RETURN SYSTEM

[75] Inventors: Kenji Takenaka; Shinichi Suzuki; Hiroaki Kayukawa; Masaki Ohta, all of Kariya, Japan

[73] Assignee: Kabushiki Kaisha Toyoda Jidoshokki Seisakusho, Aichi, Japan

[21] Appl. No.: 19,476

[22] Filed: Feb. 26, 1987

[30] Foreign Application Priority Data

Mar. 6, 1986 [JP] Japan ..... 61-49472

[51] Int. Cl.[4] ..... F04B 49/06

[52] U.S. Cl. ..... 417/222; 417/270

[58] Field of Search ..... 417/222, 270

[56] References Cited

U.S. PATENT DOCUMENTS

| | | | |
|---|---|---|---|
| 4,533,299 | 8/1985 | Swain | 417/270 |
| 4,533,905 | 11/1985 | Swain | 417/222 |
| 4,606,705 | 8/1986 | Parekh | 417/222 |
| 4,621,983 | 11/1986 | Thomas | 417/222 |

FOREIGN PATENT DOCUMENTS

| | | | |
|---|---|---|---|
| 3545581 | 7/1986 | Fed. Rep. of Germany | 417/222 |
| 3609058 | 10/1986 | Fed. Rep. of Germany | 417/222 |

*Primary Examiner*—W. L. Freeh

*Attorney, Agent, or Firm*—Burgess, Ryan & Wayne

[57] ABSTRACT

A variable displacement wobble plate type compressor with a variable angle non-rotary wobble plate, having a suction chamber for a refrigerant before compression, a discharge chamber for a compressed refrigerant, suction and compression discharge cylinder bores, pistons reciprocated by the wobble plate within the cylinder bores for compressing the refrigerant, a crankcase with a crank chamber to receive therein a drive and a wobble plate mechanism mounted about a drive shaft connectable to a rotary drive source, i.e., a vehicle engine, connected to the pistons to cause reciprocating motion of the pistons and capable of changing the wobble angle thereof, a first communication passageway providing a fluid communication between the crankcase chamber and the discharge chamber, a first control valve for closing and opening the first passageway in response to a change in a suction pressure of the refrigerant, a second communication passageway for permitting evacuation of a blowby gas from the crankcase chamber to the suction chamber, and a second control valve changing an extent of opening of the second communication passageway in response to an increase in a fluid pressure within the crankcase chamber.

5 Claims, 3 Drawing Figures

VARIABLE DISPLACEMENT WOBBLE PLATE TYPE COMPRESSOR WITH IMPROVED WOBBLE ANGLE RETURN SYSTEM

BACKGROUND OF THE INVENTION

1. Field of the Invention

The present invention relates generally to a variable displacement wobble plate type compressor with a wobble angle control unit, capable of automatically changing a compressor displacement in response to a change in a refrigerating load in an air-conditioning system in which the variable displacement wobble plate type compressor is accommodated, and more particularly, relates to a wobble angle return system incorporated in a variable displacement wobble plate type compressor for promoting the return of a wobble plate from the least wobble angle position, i.e., an erect position of the wobble plate, to a larger wobble angle position thereof, i.e., an inclined position of the wobble plate.

2. Description of the Related Art A pending U.S. patent application Ser. No. 856,760 of the same assignee as the present patent application, filed on Apr. 28, 1986, discloses a variable displacement wobble plate type compressor with a wobble angle control unit improved so as to achieve a smooth return of the wobble plate from the least inclined position thereof to a fully inclined position thereof. The compressor disclosed in the pending U.S. patent application Ser. No. 856,760 can be operated at a wide displacement range from the extremely small displacement state to the full displacement state, and therefore, the compressor can be operated so that the compressor displacement is always set at an optimum condition in accordance with a change in the refrigerating load applied to the air-conditioning system. The inventors of the present application have continued their investigation into the performance of a wobble angle control unit of a variable displacement wobble plate type compressor on the basis of the control unit of the pending U.S. patent application Ser. No. 856,760. As a result, the present inventors of the present application succeeded in contriving another wobble angle control unit of a variable displacement wobble plate type compressor, which unit is definitely different from that disclosed in the pending U.S. patent application Ser. No. 856,760, and has a function of promoting a smooth return of the wobble plate from the least angle position to a larger angle position.

SUMMARY OF THE INVENTION

An object of the present invention is, therefore, to provide a variable displacement wobble plate type compressor with a wobble angle control unit improved so as to achieve a smooth return of the wobble plate from the smallest inclined position thereof to a fully inclined position thereof, whereby the compressor smoothly starts to return from a small displacement operation to a larger displacement operation thereof as required.

Another object of the present invention is to provide a variable displacement wobble plate type compressor in which the displacement can be changed over a wide range from a very small to a large displacement.

A further object of the present invention is to provide a variable displacement wobble plate type compressor capable of being driven by a vehicle engine while preventing any loss of drive power.

In accordance with the present invention, there is provided a variable displacement wobble plate type compressor comprising: a suction chamber for a refrigerant before compression; a discharge chamber for a compressed refrigerant; a cylinder block defining therein a plurality of cylinder bores arranged so as to surround an axial drive shaft and having therein associated reciprocatory pistons disposed so as to draw the refrigerant from the suction chamber and to then discharge the compressed refrigerant into the discharge chamber; a crankcase having defined therein a chamber communicating with the cylinder bores and containing therein a drive plate mounted in such a manner that it is capable of rotating with the drive shaft as well as changing an inclination thereof with respect to an axis of the drive shaft and a non-rotating wobble plate held by the drive plate; a plurality of connecting rods connecting between the wobble plate and the pistons; a first passageway means for fluidly communicating the chamber of the crankcase with the discharge chamber; a first valve means arranged in the first passageway means, for opening and closing the first passageway means; a second passageway means for providing a fluid communication between the chamber of the crankcase and the suction chamber; a second valve means arranged in the second passageway means, for varying an extent of opening of a part of the second passageway means; a first valve control means for controlling the operation of the first valve means in response to a change in fluid pressure in the chamber of the crankcase with respect to a first predetermined pressure level, said first valve control means moving the first valve means to a first position opening the first passageway means when pressure in the chamber of the crankcase is less than the first predetermined pressure level, and to a second position closing the first passageway means when the pressure in the chamber of the crankcase is larger than the first predetermined pressure level, and a second valve control means for controlling the operation of the second valve means in response to a change in fluid pressure in the chamber of the crankcase with respect to a second predetermined pressure level, said second valve control means moving the second valve means to a first position increasing the opening area of the part of the second passageway means when the pressure in the chamber of the crankcase is larger than the second predetermined pressure level, and to a second position decreasing the extent of opening of the part of the second passageway means when the pressure in the chamber of the crankcase is not larger than the second predetermined pressure level.

BRIEF DESCRIPTION OF THE DRAWINGS

Other objects, features and advantages of the present invention will be made more apparent from the ensuing description of the embodiments of the present invention with reference to the accompanying drawings, wherein.

DESCRIPTION OF THE PREFERRED EMBODIMENTS

Figure 1:
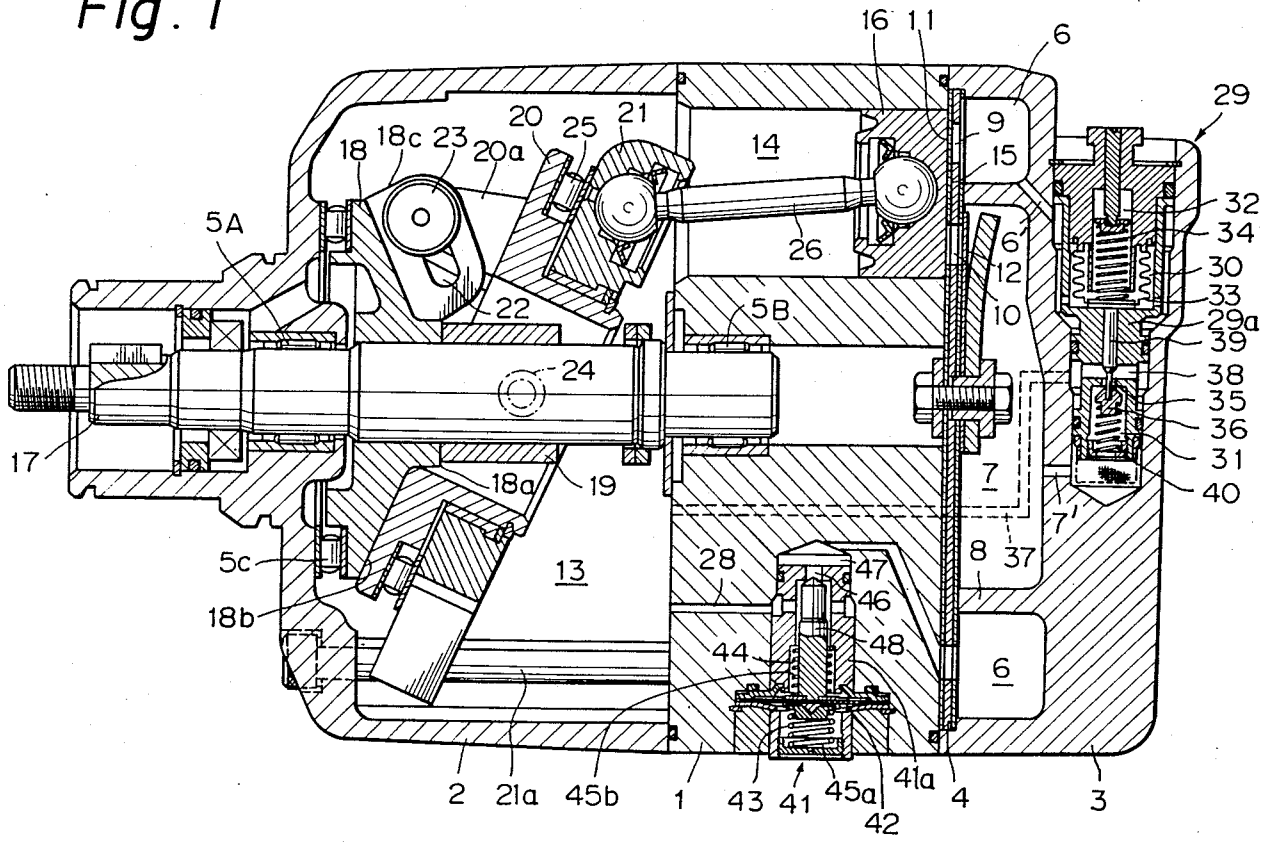
FIG. 1 is a vertical cross-sectional view of a variable displacement wobble plate type compressor with a wobble angle control unit according to a first embodiment of the present invention.

The constitutions and operation of embodiments of the present invention will now be described with reference to the accompanying drawings. It should be noted that, throughout the drawings FIGS. 1 through 3 illustrating first and second embodiments of the present invention, identical and like parts or elements are designated by the same reference numerals.

Figure 2:
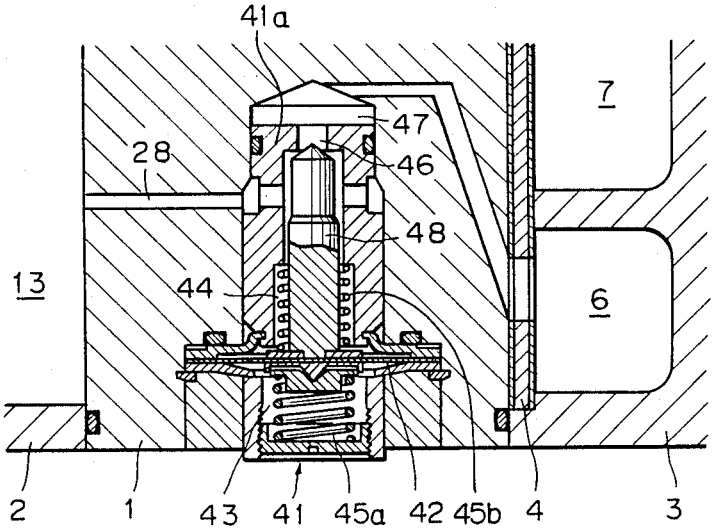
FIG. 2 is an enlarged cross-sectional view of a second valve and a valve control unit incorporated therein, of the compressor of FIG. 1.
Figure 3:
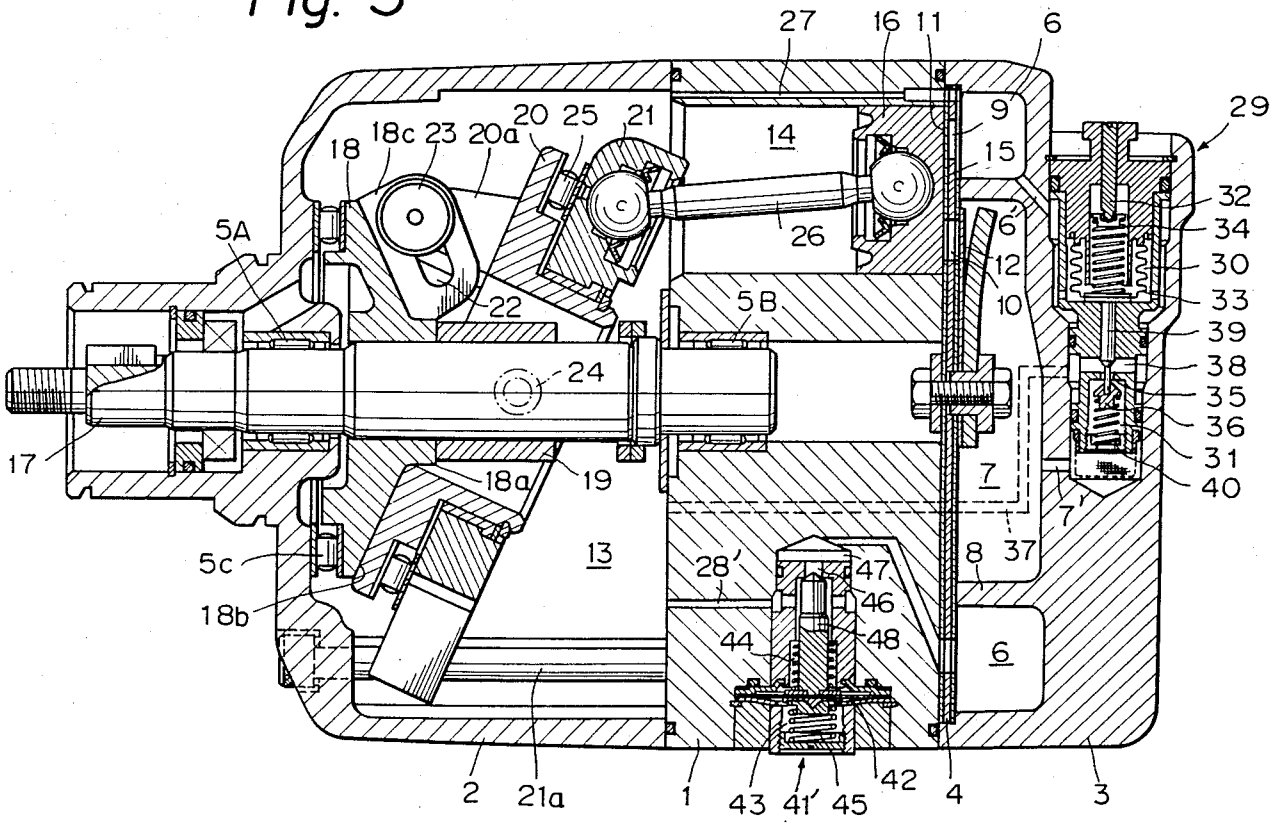
FIG. 3 is a vertical cross-sectional view of a variable displacement wobble plate type compressor with a wobble angle control unit according to a second embodiment of the present invention.

Referring to FIGS. 1 and 2, illustrating the first embodiment of the present invention, a variable displacement wobble plate type compressor applicable to an air-conditioning system of a vehicle has a cylinder block 1 in the shape of a cylindrical member having axially spaced front and rear open ends. The open front end of the cylinder block 1 is closed by a front housing or crankcase 2 in the shape of a bell-jar, and the rear open end thereof is closed by a cap-like rear housing 3, via a valve plate 4. The crankcase or front housing 2 is centrally provided with a bearing portion 5A for rotatably supporting one end of a later-described drive shaft 17. The other end of the drive shaft 17 is rotatably supported by a bearing portion 5B provided for the center of the cylinder block 1. The rear housing 3 is formed therein with an outer suction chamber 6 and an inner discharge chamber 7. The suction and discharge chambers 6 and 7 are concentric with one another, and are isolated from one another by an annular partition wall 8. The suction chamber 6 is fluidly communicatable with a later-described compression chamber 15 of each of a plurality of cylinder bores 14 formed in the cylinder block 1, via one of suction ports 9 of the valve plate 4. The discharge chamber 7 is also fluidly communicatable with the compression chamber 15 of each of the cylinder bores 14, via one of discharge ports 10 of the valve plate 4. Also, the suction and discharge chambers 6 and 7 are connected with an external refrigerating circuit of the air-conditioning system through an inlet port (not shown) and an outlet port (not shown), respectively. The above-mentioned suction port 9 of the valve plate 4 is closed by a suction valve 11 which is opened when an associated piston 16 carries out a suction stroke thereof in the cylinder bore 14. The discharge port 10 is closed by a discharge valve 12 which is opened when the associated piston 16 carries out a compression stroke thereof in the cylinder bore 14. The cylinder bores 14 of the cylinder block 1 are circumferentially arranged so as to surround the bearing portion 5B. In each of the cylinder bores 14, the afore-mentioned piston 16 is slidably and reciprocally fitted so as to define the afore-mentioned compression chamber 15 on the rear side of the cylinder block 1. Thus, the compression chamber 15 is alternately connected with the afore-mentioned suction chamber 6 and discharge chamber 7 via suction and discharge ports 9 and 10 in response to the reciprocating motion of the piston 16.

The front housing 2 has therein a cylindrical crank chamber 13 which is communicated with all of the cylinder bores 14 of the cylinder block 1. The crank chamber 13 receives therein the afore-mentioned drive shaft 17 axially arranged in the chamber 17 between the abovementioned pair of bearing portions 5A and 5B. An outer end of the drive shaft 17 is outwardly extended over the front end of the front housing 2 so that it is connectable to a vehicle engine (not shown) via an appropriate transmission unit and a clutch device. On the drive shaft 17 is mounted a drive element 18, referred to as a lug plate throughout the first and second embodiments of the present invention. The lug plate 18 having a generally round configuration is rotatably held by a thrust bearing 5C against a front inner wall of the front housing 2 and is able to rotate with the drive shaft 17. The lug plate 18 is provided, on its inner end, with an end face **18*a* with which a later-described sleeve element 19 is able to come in contact during the large displacement operation of the compressor. The lug plate 18 is also provided, around the end face 18*a*, with an inclined end face 18*b* with which a drive plate 20 is able to come in contact during the wobbling thereof, and a support arm 18*c* for supporting the drive plate 20. The support arm 18*c* and the inclined end face 18*b* are arranged so as to be circumferentially spaced apart from one another by an angle of approximately 180 degrees. The drive plate 20 formed as an annular member enclosing the drive shaft 17 is supported by the support arm 18*c* so that it is able to wobble about an axis vertical to the axis of the drive shaft 17. The support arm 18*c* is formed with an arcute hole 22 of which the center of curvature passes through points where a later-described wobble plate 21 and connecting rods 26 are connected together via ball and socket joints during the rotation of the lug plate 18. On the other hand, the drive plate 20 has a bracket 20*a* extending toward and mated with the support arm 18*c* of the lug plate 18. The bracket 20*a* and the support arm 18*c* are operatively connected together by means of a guide pin 23 fixed to the bracket 20*a* and movably engaged within the arcute hole 22 of the support arm 18*c* so that the drive plate 20 is permitted to wobble against the lug plate 18 while rotating with the drive shaft 17. That is, the drive plate 20 is able to wobble so as to incline with respect to a plane perpendicular to the axis of the drive shaft 17. The sleeve element 19, which is slidably mounted on the drive shaft 17, is connected to the drive plate 20. That is, the cylindrical sleeve element 19 has a pair of diametrically opposed pivots 24 on which the drive plate 20 is pivotally mounted. Therefore, the sleeve element 19 slides along the drive shaft 17 in association with the wobbling motion of the drive plate 20. The drive plate 20 holds thereon a non-rotating wobble plate 21 by means of a thrust bearing 25. The wobble plate 21 is permitted to carry out only a wobbling motion together with the drive plate 20 and is formed as an annular element enclosing the drive shaft 17. The non-rotating wobble plate 21 is operatively connected with the afore-mentioned respective pistons 16 by means of respective connecting rods 26 and ball and socket joints provided on both ends of each connecting rod 26. At this stage, it should be noted that the connections between the wobble plate 21 and respective pistons 16 are established in such a manner that each of the pistons 16 is brought to its top dead center (i.e., the rearmost position in each cylinder bore 14) by the wobble plate 21 via the associated connecting rod 22 when the support arm 18*c* of the lug plate 18 is rotated to a position where the support arm 18*c* is in axial alignment with each of the cylinder bores 14. The wobbling motion of the non-rotating wobble plate 21 is guided by a guide pin 21*a* fixedly and axially extended through the front housing 2, cylinder block 1, and the rear housing 3**.

The rear housing 3 is provided with a control valve 29 hereinafter referred to as a first control valve 29 for changing the wobble angle of the drive and wobble plates 20 and 21 by controlling a pressure level within the crank chamber 13. The first control valve 29 includes a housing member 29*a* which defines therein a suction pressure chamber 30 and a discharge pressure chamber 31 arranged in axial alignment but isolated from one another. The suction pressure chamber 30 is communicated with the suction chamber 6 via a connecting passageway 6', while the discharge pressure chamber 31 is communicated with the discharge chamber 7 via a connecting passageway 7'. The suction pressure chamber 30 receives therein a bellows member 33 which has therein an atmospheric pressure chamber 32 communicated with the atmosphere. The atmospheric pressure chamber 32 is at the center of the suction pressure chamber 30, and contains a spring 34 constantly urging the bellows member 33 toward the extended position (toward the discharge pressure chamber 31). A valve seat 35 is formed at one end of the discharge pressure chamber 31 adjacent to a port 38 formed between the suction and discharge pressure chambers 30 and 31. The port 38 is communicated with the crank chamber 13 by means of a passageway 37 to supply the crank chamber 13 with a discharge pressure. The discharge pressure supply passageway 37 is extended from the port 38 through the rear housing 3 and the cylinder block 1.

The afore-described bellows member 33 is connected to one end of a valve rod 39 having the other end thereof extending into the discharge pressure chamber 31 through the port 38 and the valve port 35, and connected to a valve element 36 movable with the rod 39 toward and away from the valve port 35. The movement of both valve rod 39 and valve element 36 is caused by the extension and compression of the bellows member 33 against spring force of a spring 40 housed in the discharge pressure chamber 31.

The cylinder block 1 is formed with a fluid passageway 28 extending between the suction chamber 6 of the rear housing 3 and the crank chamber 13 of the front housing 2 so as to provide a fluid communication between both chambers 6 and 13. That is, the fluid passageway 28 is provided as a relief passageway for delivering a high pressure gas of the crank chamber 13 toward the suction chamber 6. In a portion of the fluid passageway 28, there is provided another control valve 41 (hereinafter referred to as a second control valve 41) which is able to operate so as to control the opening area of the portion of the fluid passageway 28. The second control valve 41 includes a valve barrel 41*a* which defines therein an atmospheric pressure chamber 43 opening toward the atmosphere, and an axially elongated pressure sensing chamber 44 communicated with the crank chamber 13. The valve housing 41*a* is hermetically fitted in a bore formed in the cylinder block 1, and the bore is fluidly communicated with the fluid passageway 28. The atmospheric pressure chamber 43 and the pressure sensing chamber 44 is isolated by a diaphragm 42. Within the atmospheric chamber 43, a compression spring 45*a* having one end engaged with the diaphragm 42 is housed. The pressure sensing chamber 44 is communicatable with a port 47 formed in the abovementioned bore of the cylinder block 1, via a valve seat 46 formed in an end of the valve housing 41*a*. Within the pressure sensing chamber 44 is housed an axially movable valve element 48 having an end connected to the diaphragm 42 and an opposite coned end cooperable with the valve seat 46 so as to carry out the regulation of the opening area of the fluid passageway 28 at the portion of the valve seat 46. Another spring 45*b* is provided within the pressure sensing chamber 44 so that one end of the spring 45*b* is seated on a stepped portion of the valve housing 41*a*, and the other end is connected to the diaphragm 42. The spring 45*b* is operable to smoothly move the valve element 48 away from the valve port. At this stage, it should be understood that the coned end of the valve element 48 is always spaced apart from the valve port 46 against the compression spring 45*a* within the atmospheric pressure chamber 43. Particularly, when the compressor is at a complete stop, in a large displacement operation or a partial small displacement operation, the coned end of the valve element 48 is moved by the diaphragm 42 away from the valve port 46 to a position where a predetermined amount of opening area determined by a pressure difference between a pressure of the crank chamber 13 and the atmospheric pressure is formed in the fluid passageway 28 between the valve element 48 and the valve seat 46. The above-mentioned predetermined amount of opening area of the fluid passageway 28 is established by a pressure difference between a gas pressure prevailing in the crank chamber 13 and the atmospheric pressure in the atmospheric pressure chamber 43. On the other hand, when the compressor is at a small displacement running, the valve element 48 is moved far away from the valve seat 46 to another position where an opening area larger than the above-mentioned predetermined amount of opening area is aquired.

Referring now to FIG. 3, which illustrates a second embodiment of the present invention, the variable displacement wobble plate type compressor of the second embodiment is different from the first embodiment of FIGS. 1 and 2 in that a second control valve 41' arranged in a portion of a fluid communication passageway 28' (hereinafter referred to as a bypass relief passageway 28') operates so as to change the portion of the bypass passageway 28' from a completely closed position to an appropriately opened state. Further, the compressor of the second embodiment is provided with a separate bypass passageway 27 (hereinafter referred to as a constant bypass passageway 27) extended from the crank chamber 13 to the suction chamber 6 through the cylinder block 1 and the valve plate 4. The constant bypass passageway 27 formed as an axial throttled aperture disposed at the peripheries of the cylinder block 1 and the valve plate 4 provides an unchanging fluid communication between the suction chamber 6 and the crank chamber 13.

When the compressor is at a complete stopping, at a large displacement running or a partial small displacement running, the second control valve 41' closes the bypass passageway 28'. While when the compressor is at a small displacement running, the second control valve 41' establishes a predetermined amount of opening area in the bypass passageway 28' on the basis of a pressure difference between a pressure in the atmospheric pressure chamber 43 and the pressure sensing chamber 44.

The operation of the variable displacement wobble plate type compressor according to the first and second embodiments will be described hereunder.

With the first embodiment shown in FIGS. 1 and 2, when the operation of compressor is stopped, the pressure in the suction chamber 6 and that in the crank chamber 13 are usually balanced at a level higher than a preset pressure level corresponding to the atmospheric pressure plus a pressure exerted by the spring 34 in the bellows member 33 of the first control valve 29. This balanced condition of the crank chamber 13 and the suction chamber 6 is achieved by the fluid communication between both chambers 13 and 6, via the relief passageway 28 (note: the second control valve 41 is not able to completely close the relief passageway 28). Therefore, a high pressure of the crank chamber 13, i.e., a high pressure of the suction chamber 6 prevails in the suction pressure chamber 30 of the first control valve 29. Accordingly, the bellows member 33 is contracted against the atmospheric pressure and the pressure of the spring 34, so as to move the valve element 36 toward the valve seat 35. Consequently, the communication between the crank chamber 13 and the discharge pressure chamber 31 of the first control chamber 29 is interrupted due to closing of the valve seat 35 by the valve element 36. That is, the pressure of the crank chamber 13 is maintained at an equal level to that of the suction chamber 6, and accordingly, the pressure of the crank chamber 13 is applied to the back face of each piston 16. The same pressure of the crank chamber 13 is also applied to one of the faces of the diaphragm 42 of the second control valve 41, via the relief passageway 28. Since the pressure of the crank chamber 13 is larger than a pressure applied to the other face of the diaphragm 42, i.e., a pressure corresponding to the atmospheric pressure plus a pressure exerted by the spring 45*a*, the diaphragm 42 is urged toward the atmospheric chamber 43, and therefore, the valve element 48 is moved away from the valve seat 46 so that an ordinary amount of opening is retained between the end of the valve element 48 and the valve seat 46. Therefore, the relief passageway 28 provides a sufficient fluid communication between the crank chamber 13 and the suction chamber 6.

When the operation of the compressor is started by connecting the drive shaft 17 to the vehicle engine via a clutch device, such as a conventional solenoid clutch, rotation of the drive plate 20 is begun. At this stage, if a cooling load required for air-conditioning the vehicle compartment is large, the rotation of the drive plate 20 is carried out while maintaining a large wobble angle thereof. Accordingly, the wobble plate 21 is also maintained at the large wobble angle, and the pistons 16 connected to the wobble plate 21 carry out reciprocating motions within the associated cylinder bores 14 at a large reciprocating stroke. As a result, the large displacement operation of the compressor takes place.

During the continuation of the large displacement operation of the compressor, the second control valve 41 retains the above-mentioned ordinary amount of opening between the valve seat 46 and the valve element 48. That is, the crank chamber 13 is communicated with the suction chamber 6. While the compressor carries out a large displacement operation, a large amount of refrigerant containing therein a sufficient amount of lubricating oil component is circulated through the refrigerating circuit including the compressor. Therefore, in the compressor, the sufficient amount of oil component of the refrigerant drawn into the cylinder bores 14 of the cylinder block 1 forms an oil film and thus applies a high sealing effect between the walls of the cylinder bores 14 and the circumferences of the pistons 16, restricting the flow of the blowby gas from the compression chambers 15 of the cylinder bores 14 to the crank chamber 13. As a result, due to the fluid communication between the crank chamber 13 and the suction chamber 6 established by means of the relief passageway 28, the crank chamber pressure can be maintained at a constant level equivalent to the pressure level of the suction chamber 6.

With a continuation of the large displacement operation of the compressor for an appropriate period of time, the vehicle compartment to be air-conditioned is cooled, and the cooling load (the thermal load applied to the evaporator of the air-conditioning system) is reduced. In response to a reduction in the cooling load, the suction pressure of the refrigerant sent from the evaporator into the suction chamber 6 of the compressor is lowered. When the suction pressure of the suction chamber 6 becomes lower than a set pressure level of the first control valve 29, i.e., a pressure level corresponding to the combination of the atmospheric pressure and a pressure exerted by the spring 34, the bellows member 33 is extended by a pressure difference between the suction pressure of the suction chamber 6 and the set pressure of the first control valve 29, until the valve element 36 is moved away from and opens the valve port 35. As a result, the discharge chamber 31 of the first control valve 29 is fluidly communicated with the discharge pressure supply passageway 37. Accordingly, the compressed refrigerant having a high discharge pressure is supplied from the discharge chamber 7 to the crank chamber 13 so that the pressure level in the crank chamber 13 is increased. Consequently, the increased pressure in the crank chamber 13 acts on the back face of each piston 16 and decreases the piston stroke of each piston 16. The decrease in the piston stroke of the pistons 16 causes a reduction in the wobbling angle of the drive and wobble plates 20 and 21. Thus, the compressor displacement is partially reduced. However, with regard to the second control valve 41, the spring 45*a* received in the atmospheric pressure chamber 43 of the second control valve 41 is formed so as to be slightly stronger than the spring 34 received in the atmospheric pressure chamber 32 of the first control valve 29. Thus, the movement of the valve element 48 does not occur, and the opening area of the valve port 46 is maintained at an extent equal to that occurring in the stop of operation of the compressor or in the large displacement operation of the compressor.

The continuation of the operation of the compressor further cools the vehicle compartment, and reduces a thermal load applied to the evaporator of the air-conditioning system. As a result, the suction pressure of the refrigerant drawn into the suction chamber 6 of the compressor from the outside circuit is reduced. The reduction in the suction pressure of the refrigerant causes a reduction in the piston stroke of the pistons 16. Accordingly, the wobble angle (the angle of inclination from the erected position of the wobble plate 21) of the drive and wobble plates 20 and 21 is decreased, so that a small displacement operation of the compressor is obtained.

When the small displacement operation of the compressor is carried out, since the suction pressure is reduced to a low pressure level, the refrigerant drawn into the cylinder bores 14 of the cylinder block 1 is not able to apply a high sealing effect between the walls of the cylinder bores 14 and the circumferences of the pistons 16. Therefore, the amount of the blowby gas leaking from the compression chambers 15 into the crankcase chamber 13 increases, thereby causing an increase in the pressure in the crankcase 13.

On the other hand, when the small displacement operation of the compressor is carried out, the pressure sensing chamber 44 of the second control valve 41 which is communicated with the crank chamber 13, is subjected to a pressure that gradually becomes larger than the pressure in the atmospheric pressure chamber 43. As a result, the diaphragm 42 is urged toward the atmospheric pressure chamber 43 so as to move the valve element 48 away from the valve port 46. That is, an increase in the opening area of the valve port 46 takes place. Therefore, the opening area of the valve port 46 of the second control valve 41 is widened while permitting a large amount of the blowby gas of the crank chamber 13 to escape into the suction chamber 6 via the relief passageway 28 and the widened valve port 46 of the second control valve 41. Thus, an increase in the pressure within the crank chamber 13 is suppressed. That is, the pressure within the crank chamber 13 can be maintained at a substantially constant level corresponding to the level of the discharge pressure of the refrigerant gas, owing to the cooperation of the first and second control valves.

It should be noted that since during the small displacement operation of the compressor, the pressure level within the crank chamber 13 is always maintained at a constant level corresponding to the discharge pressure level of the compressed refrigerant, the drive and wobble plates 20 and 21 carrying out a wobbling motion at a small wobble or inclination angle can be easily and smoothly returned to a large wobble angle position where the drive and wobble plates 20 and 21 carry out a wobbling motion at a large wobble or inclination angle.

Referring to FIG. 3, which illustrates the second embodiment of the present invention, the constant bypass passageway 27 constantly provides an appropriate and ordinary amount of fluid communication between the crank chamber 13 and the suction chamber 6 over the entire operation range from an operation stop to a full displacement operation of the compressor.

On the other hand, when the operation of the compressor is stopped, when the large displacement operation of the compressor is carried out, or when the compressor is operated at a reduced displacement where the compression capacity thereof is partly decreased from that of the large displacement operation, the valve element 48 of the second control valve 41' is set at a closed position completely closing the valve port 46 of the second control valve 41'. Therefore, when the operation of the compressor is stopped, when the large displacement operation of the compressor is carried out, or when the compressor is operated at a reduced displacement where the compression capacity thereof is partly decreased from that of the large displacement operation, a blowby gas leaking from the compression chambers 15 to the crank chamber 13 is able to return to the suction chamber 6 through the constant bypass passageway 27.

When the compression capacity of the compressor is reduced, i.e., when the small displacement operation of the compressor is carried out with the drive and wobble plates 20 and 21 at a small inclination or wobble angle with regard to the erected position thereof, or when the discharge pressure of the refrigerant reaches an extremely high level during the large displacement operation of the compressor, the valve element 48 is moved away from the valve port due to a pressure difference between the pressure sensing chamber 44 and the atmospheric pressure chamber 43, and the valve port 46 is opened. As a result, the bypass passageway 28' is opened so as to communicate between the crank chamber 13 and the suction chamber 6. Accordingly, both the constant bypass passageway 27 and the opened bypass passageway 28' can cooperate to achieve a rapid evacuation of the high pressure blowby gas from the crank chamber 13 to the suction chamber 6. Therefore, during the small displacement operation of the compressor as well as during the high delivery pressure and large displacement operation of the compressor, the crank chamber 13 can be prevented from reaching an extremely high pressure condition. That is, the crank chamber 13 is constantly and stably maintained at a substantially fixed pressure condition near to the delivery pressure of the compressed refrigerant. Therefore, it is ensured that the drive and wobble plates 20 and 21 are able to readily and smoothly return from the small wobble angle position thereof to a larger wobble angle position (a large displacement operation of the compressor), in response to an increase in a cooling load.

From the foregoing description of the first and second preferred embodiments of the present invention, it will be understood that, in a variable displacement wobble plate type compressor according to the present invention, an extent of a fluid communication between the crank chamber and the suction chamber is changed, by a crank chamber pressure sensitive control valve, between a fixed ordinary opening area state to a widened state in response to a change in an operating condition of the compressor ranging from the stop of the compressor to a large displacement operation via a small displacement operation. Therefore, while the small displacement operation of the compressor is carried out or when the environmental temperature of an air-conditioning system employing the compressor rises, an appreciable amount of the blowby gas leaking from the compression chambers of the compressor into the crank chamber can be effectively evacuated from the crankcase chamber to the suction chamber of the compressor by means of the widened fluid communication passageway. Accordingly, the pressure in the crank chamber can be maintained at a controlled pressure level during the small displacement operation of the compressor. Thus, the variable angle wobble plate and the drive plate are able to readily and smoothly return from the small displacement operation (an erect position and a small inclination position of the wobble plate) to the large displacement operation (a large inclination position of the wobble plate).

We claim:

1. A variable displacement wobble plate type compressor comprising:

a housing element having therein a suction chamber for a refrigerant before compression and a discharge chamber for a refrigerant after compression;

a cylinder block defining therein a plurality of cylinder bores arranged so as to surround an axial drive shaft and having therein associated reciprocatory pistons disposed so as to draw the refrigerant from said suction chamber and to then discharge the compressed refrigerant into said discharge chamber;

a crankcase having defined therein a chamber communicating with said cylinder bores and containing therein a drive plate mounted in such a manner that it is capable of rotating with said drive shaft as well as changing an inclination thereof with respect to said drive shaft and a non-rotating wobble plate held by said drive plate;

a plurality of connecting rods connecting between said wobble plate and said pistons;

a first passageway means for fluidly communicating said chamber of said crankcase with said discharge chamber of said housing element;

a first valve means arranged in said first passageway means, for opening and closing said first passageway means;

a second passageway means for providing a fluid communication between said chamber of said crankcase and said suction chamber of said housing element;

a second valve means arranged in said second passageway means, for varying an extent of opening of a part of said second passageway means;

a first valve control means for controlling an operation of said first valve means in response to a change in fluid pressure in said chamber of said crankcase with respect to a first predetermined pressure level, said first valve control means moving said first valve means to a first position opening said first passageway means when pressure in said chamber of said crankcase is less than said first predetermined pressure level, and to a second position closing said first passageway means when pressure in said chamber of said crankcase is larger than said first predetermined pressure level, and;

a second valve control means for controlling an operation of said second valve means in response to a change in fluid pressure in said chamber of said crankcase with respect to a second predetermined pressure level, said second valve control means moving said second valve means to a first position increasing the extent of opening of said part of said second passageway means when pressure in said chamber of said crankcase is larger than said second predetermined pressure level, and to a second position decreasing the extent of opening of said part of said second passageway means when pressure in said chamber of said crankcase is not larger than said second predetermined pressure level.

2. A variable displacement wobble plate type compressor, according to claim 1, further comprising a third passageway means for providing a constantly throttled communication between said suction chamber and said chamber of said crankcase.

3. A variable displacement wobble plate type compressor, according to claim 1, wherein said first valve means comprises:

a cylindrical hollow valve body built in to said housing element;

a bellows member arranged in said cylindrical hollow valve body so as to define in said valve body an atmospheric chamber and a suction pressure chamber communicated with said suction chamber of said housing element, said bellows member being provided for being moved in response to a change in a suction pressure of said refrigerant before compression;

a spring element arranged in said atmospheric pressure chamber for urging said bellows member under a predetermined spring bias, and;

a valve rod element movably arranged in said cylindrical hollow valve body, and having a first end connected to said bellows member and a second end provided with a valve element for opening and closing said first passageway means in response to a movement of said valve rod.

4. A variable displacement wobble plate type compressor, according to claim 1, wherein said second valve means comprises:

a valve barrel having a valve port located in said part of said second passageway means;

an axial valve element movably arranged in said valve barrel and having a first end cooperable with said valve port thereby changing the extent of opening of said part of said second passageway means, and a second end axially opposite to said first end;

a diaphragm member defining in said valve barrel an atmospheric chamber and a pressure sensing chamber communicated with said chamber of said crankcase via said second passageway means, said diaphragm member being connected to said second end of said valve element;

a spring element arranged in said atmospheric chamber and urging said diaphragm member toward said pressure sensing chamber under a predetermined spring bias.

5. A variable displacement wobble plate type compressor, according to claim 4, wherein said second valve means is built in to a part of said cylinder block.

* * * * *